US007527675B2

(12) United States Patent
Bertuccioli et al.

(10) Patent No.: US 7,527,675 B2
(45) Date of Patent: May 5, 2009

(54) ELECTROSTATIC PARTICULATE SEPARATION SYSTEM AND DEVICE

(75) Inventors: Luca Bertuccioli, East Longmeadow, MA (US); Bruce H. Easom, Groton, MA (US); Leo A. Smolensky, Concord, MA (US); Sergei F. Burlatsky, West Hartford, CT (US); Eric J. Gottung, Simsbury, CT (US); Michael A. Sloan, West Hartford, CT (US); Lewis G. Hinman, III, Hebron, CT (US)

(73) Assignee: United Technologies Corporation, Hartford, CT (US)

( * ) Notice: Subject to any disclaimer, the term of this patent is extended or adjusted under 35 U.S.C. 154(b) by 385 days.

(21) Appl. No.: 11/520,261

(22) Filed: Sep. 13, 2006

(65) Prior Publication Data

US 2008/0060522 A1 Mar. 13, 2008

(51) Int. Cl.
*B03C 3/15* (2006.01)

(52) U.S. Cl. ..... 96/61; 96/69; 96/96; 96/99

(58) Field of Classification Search ..... 96/61, 96/69, 96, 99; 95/59, 78
See application file for complete search history.

(56) References Cited

U.S. PATENT DOCUMENTS

| | | | | | |
|---|---|---|---|---|---|
| 2,081,772 | A | * | 5/1937 | Saint-Jacques | 95/63 |
| 3,720,312 | A | | 3/1973 | Shook et al. | |
| 4,010,011 | A | * | 3/1977 | Reif | 96/61 |
| 4,209,306 | A | | 6/1980 | Feldman et al. | |
| 4,212,653 | A | * | 7/1980 | Giles | 95/271 |
| 4,244,709 | A | | 1/1981 | Chang | |
| 4,273,747 | A | | 6/1981 | Rasmussen | |
| 4,352,681 | A | | 10/1982 | Dietz | |
| 4,553,987 | A | | 11/1985 | Artama et al. | |
| 4,744,910 | A | * | 5/1988 | Bossard | 204/572 |
| 4,778,493 | A | | 10/1988 | Fitch et al. | |
| 4,960,445 | A | | 10/1990 | Helfritch | |
| 5,591,253 | A | | 1/1997 | Altman et al. | |
| 5,599,508 | A | | 2/1997 | Martinelli et al. | |
| 5,683,494 | A | | 11/1997 | Altman et al. | |
| 5,827,352 | A | | 10/1998 | Altman et al. | |
| 5,961,693 | A | | 10/1999 | Altman et al. | |
| 5,968,231 | A | * | 10/1999 | Parmentier et al. | 95/28 |

(Continued)

FOREIGN PATENT DOCUMENTS

EP 0 995 495 A1 4/2000

(Continued)

OTHER PUBLICATIONS

Official Search Report and Written Opinion of the Patent Cooperation Treaty in counterpart foreign Application No. PCT/US2007/17510 filed Aug. 2, 2007.

*Primary Examiner*—Richard L Chiesa
(74) *Attorney, Agent, or Firm*—Kinney & Lange, P.A.

(57) ABSTRACT

A device separates particulates from a gas stream flowing through the device. The device includes at least one high voltage electrode and a substantially cylindrical separator. The high voltage electrode applies a first voltage to the gas stream. The separator has an inlet for introducing the gas stream into the separator tangentially to an interior wall of the separator, a particulate outlet for expelling the particulates from the separator, and a gas stream outlet.

37 Claims, 10 Drawing Sheets

U.S. PATENT DOCUMENTS

| | | | | |
|---|---|---|---|---|
| 5,972,215 | A * | 10/1999 | Kammel | 210/243 |
| 6,017,381 | A | 1/2000 | Dunn et al. | |
| 6,096,118 | A | 8/2000 | Altman et al. | |
| 6,228,149 | B1 * | 5/2001 | Alenichev et al. | 95/78 |
| 6,530,981 | B2 | 3/2003 | Stivers | |
| 6,858,064 | B2 * | 2/2005 | Bologa et al. | 95/65 |
| 6,926,758 | B2 * | 8/2005 | Truce | 95/78 |
| 7,156,902 | B1 * | 1/2007 | Altman | 96/53 |
| 2002/0017194 | A1 | 2/2002 | Stivers | |
| 2005/0132880 | A1 | 6/2005 | Chang | |

FOREIGN PATENT DOCUMENTS

| | | |
|---|---|---|
| GB | 2 068 659 A | 8/1981 |
| JP | 57045356 | 3/1982 |
| WO | WO 95/17240 | 6/1995 |

* cited by examiner

ELECTROSTATIC PARTICULATE SEPARATION SYSTEM AND DEVICE

BACKGROUND OF THE INVENTION

The present invention relates generally to the field of separating and removing particulates from gas streams. In particular, the invention relates to an electrostatic particulate separation system for separating and removing particulates from gas streams.

Conventional methods of removing particulates, such as ash and dust, from a gas stream include using barrier filters such as fabric filters and baghouses, electrostatic precipitators, or cyclonic separators. Each of these approaches has its specific limitations that will be described briefly in turn.

Barrier filters typically induce significant pressure drops that translate into significant parasitic losses. In retrofit applications, accommodating the pressure drop caused by the filter may require costly modification of plant fans. In addition, filters have a limited life and must be replaced at regular intervals, resulting in increased operational costs and downtime.

Electrostatic precipitators (ESP) are particularly effective at high particulate loadings. However, at low loadings and for small particle diameters, the separation efficiency may be much lower. Thus, if very low outlet particle concentrations or capture of small diameter particles is required, the size and cost of the ESP can increase very significantly. ESPs also require that the collected particulates be periodically cleaned from the collection plates, typically through rapping, in order to maintain the efficiency of the system. This rapping can produce a temporary increase in the particulate concentration at the ESP outlet, thus limiting the minimum average outlet concentration that can be achieved.

Cyclonic separators do not require cleaning and can thus operate continuously. However, cyclonic separators are typically only effective for larger diameter particulates and result in significant pressure drops, leading to parasitic losses in the system.

Examples of electrostatically enhanced separators currently used in the art are described in U.S. Pat. Nos. 5,591,253 and 5,683,494 (Altman et al.), which are hereby incorporated by reference.

BRIEF SUMMARY OF THE INVENTION

A device for separating particulates from a gas stream includes at least one high voltage electrode and at least one substantially cylindrical separator. The high voltage electrode applies voltage to the gas stream. The separator has an inlet for introducing the gas stream into the separator tangentially to an interior wall of the separator, a particulate outlet for expelling the particulates from the separator, and a gas stream outlet. The device may be incorporated into an electrostatic particulate separation system.

DETAILED DESCRIPTION

Figure 1:
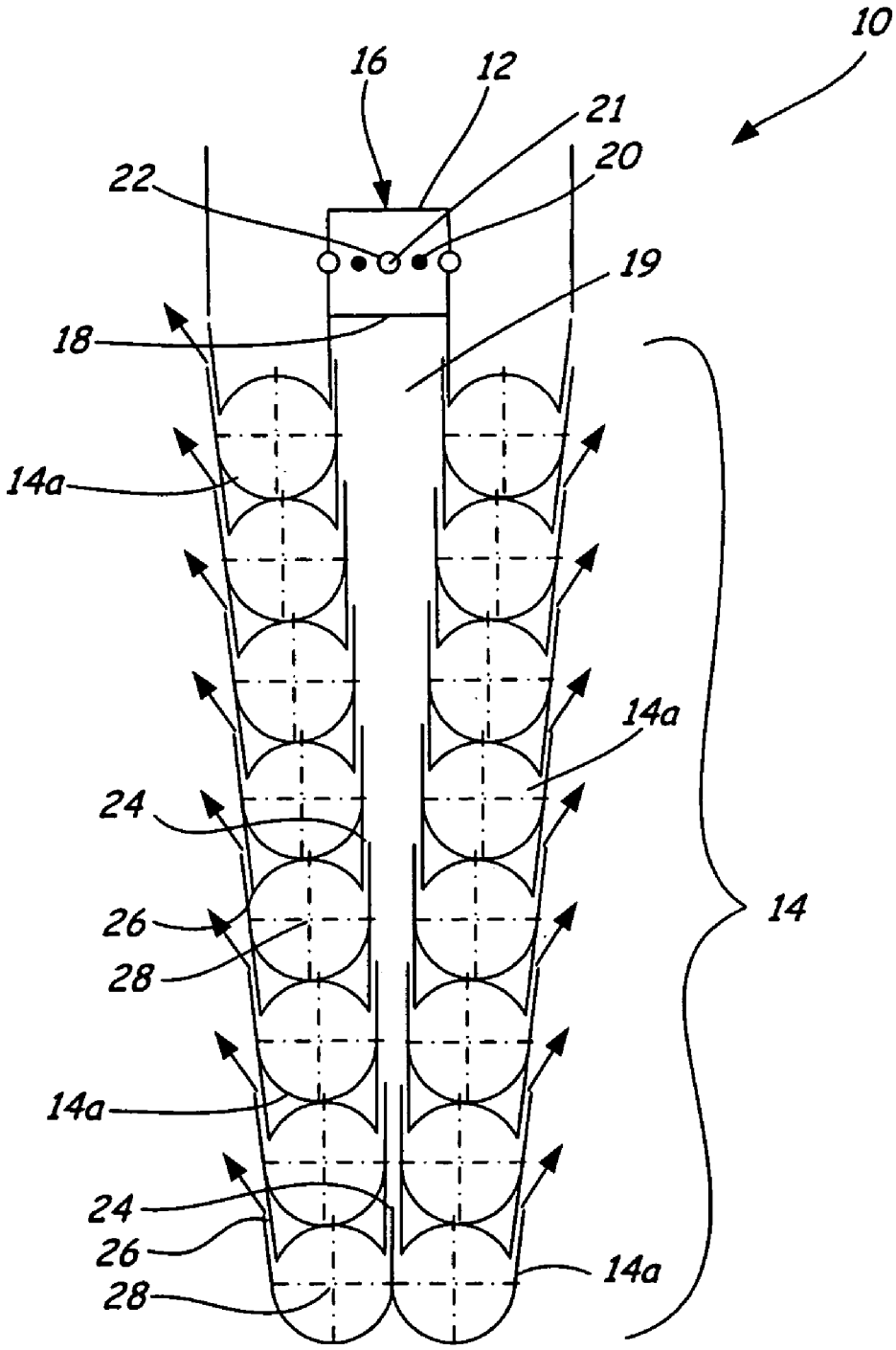
FIG. 1 is a top view of an electrostatic particulate separation system having a precharger and a separator module.

FIG. 1 shows a top view of electrostatic particulate separation system 10 with precharger 12 and separator module 14. Electrostatic particulate separation system 10 separates particulates from a gas stream passing through separation system 10 at an efficiency of between approximately 70% and approximately 99%. The particulates are concentrated and expelled from the gas stream, forming a particulate bleed stream and a clean gas stream. Use of a particulate bleed stream eliminates the need to clean separator module 14, a common requirement when using conventional means, such as an electrostatic precipitator, to collect particulates.

Precharger 12 is positioned upstream of separator module 14 and has an inlet 16 and an outlet 18. Precharger outlet 18 is in communication with separator inlet manifold 19. The gas stream enters separator module 14 from separator inlet manifold 19 at a slot velocity of between approximately 5 feet per second (ft/s) and approximately 35 ft/s. The gas stream preferably enters separator module 14 at a slot velocity of between approximately 10 ft/s and 30 ft's. The gas stream most preferably enters separator module 14 at a slot velocity of between approximately 12 ft/s and approximately 22 ft's. At these flow velocities, erosion problems or degradation of separation system 10 are minimized or prevented. This is in comparison to an electrostatic precipitator which has a typical inlet velocity of approximately 4 ft/s or a cyclonic separator which has a typical gas velocity of approximately 50 ft/s or more.

Discharge electrode 20 of precharger 12 applies a first negative voltage to the gas stream flowing through separation system 10. This voltage causes ionization of the gas within precharger 12 such that there is corona formation. Ionizing the molecules results in positive ions, negative ions, and free electrons. The electric field imposed between discharge electrode 20 and grounded electrode 21 attracts the positive ions to discharge electrode 20. Simultaneously, the negative ions and free electrons are attracted to grounded electrode 21 and cause the particulates in precharger 12 to acquire a negative charge by collision or diffusion.

In one embodiment, discharge electrode 20 of precharger 12 applies a pulsed voltage to the gas stream. The level of voltage applied to the gas stream is typically limited by sparking and/or arcing. When the applied voltage is pulsed rather than continuous, a higher average voltage can be applied to the gas stream without sparking, resulting in the particulates having a higher charge. This in turn reduces the size of precharger 12 and increases the effectiveness of separator module 14.

In one embodiment, dielectric coating 22 is coated on grounded electrode 21 of precharger 12. Coating 22 serves to tailor the corona at discharge electrode 20 and to reduce the likelihood of sparking or arcing within precharger 12. Coating 22 can include, but is not limited to: glass, polymers, or dielectric material. The particulate-charged gas stream leaves precharger 12 through outlet 18 and flows to separator inlet manifold 19 and through separator module 14. Although FIG. 1 depicts precharger 12 as having only one row of electrodes 20 and 21, precharger 12 may optionally include multiple rows of electrodes 20 and 21. In addition, although FIG. 1 depicts grounded electrodes 21 as having a tubular shape, grounded electrodes 21 may have other geometric configurations, including, but not limited to, plates.

Separator module 14 is formed from a plurality of individual separators 14*a*. Each individual separator 14*a* has a gas stream inlet 24, a particulate outlet or bleed stream outlet 26, and a gas stream outlet 28. Separators 14*a* of separator module 14 are arranged in parallel in order to process an increased amount of flow. Separators 14*a* are also arranged in a chevron pattern in which gas stream inlet 24 and particulate outlet 26 of each of separators 14*a* are arranged preferably, but not necessarily, approximately 180 degrees apart with a slight angle between gas stream inlets 24 and particulate outlets 26 of adjacent separators 14*a* to allow for separators 14*a* to be nested in relation to one another. Separator modules 14 are then positioned in tiers. This arrangement allows processing of a large volume of flow while having the flexibility of being connectable to existing plant infrastructures. Separation system 10 is thus easily adaptable for retrofitting into existing infrastructures, such as an electrostatic precipitator outlet.

Although FIG. 1 is discussed as including precharger 12, separation system 10 may optionally function without a precharger to charge the particulates in the gas stream before entering separator module 14. In this case, a discharge electrode in separator module 14 may be used to create corona within separator 14*a*. The particulates are then charged within each separator 14*a*, eliminating the need for precharger 12. Alternatively, separator modules 14 may be installed downstream of an existing electrostatic precipitator, in which case precharger 12 may also be eliminated.

Figure 2:
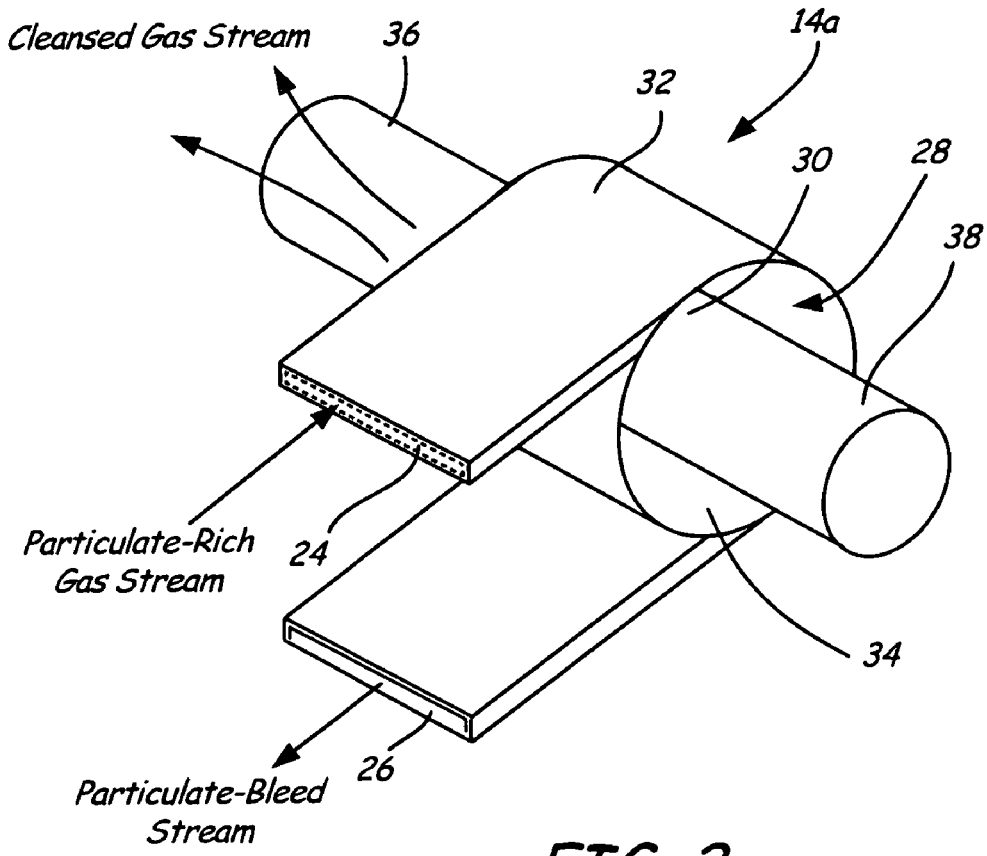
FIG. 2 is a partial, perspective cut-away view of a separator of the electrostatic particulate separation system.
Figure 3:
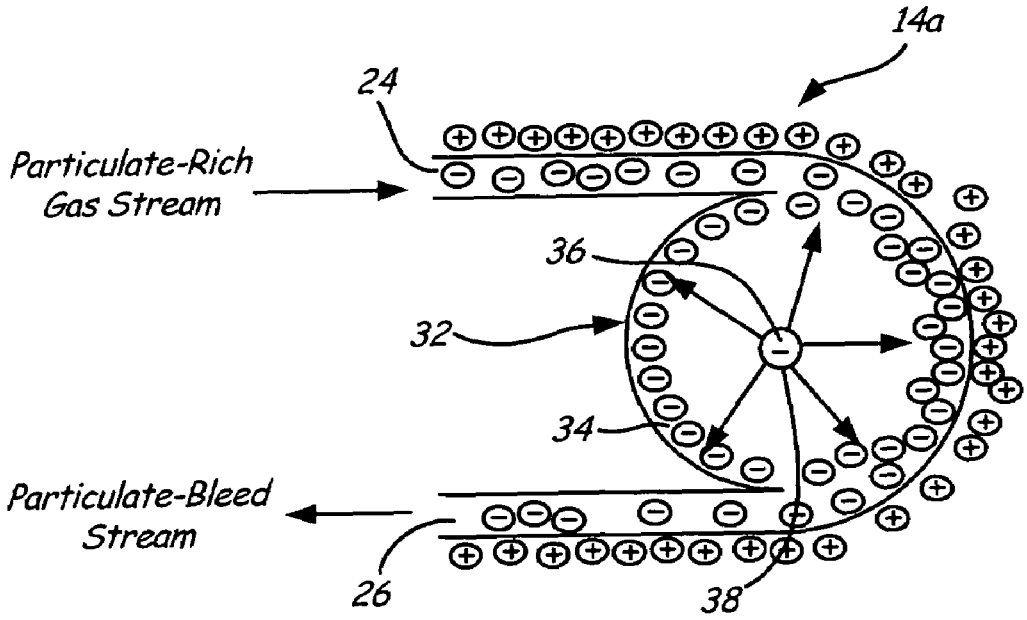
FIG. 3 is a cross-sectional schematic view of a separator of the electrostatic particulate separation system.

FIGS. 2 and 3 show a partial isometric view of individual separator 14*a* and a cross-sectional schematic view of separator 14*a* diagramming the positive and negative charges within separator 14*a*, respectively, and will be discussed in conjunction with one another. For the sake of simplicity, FIGS. 2 and 3 will be discussed in reference to only one separator 14*a*. However, all separators 14*a* of separation system 10 function in the same manner. Separator 14*a* has an elongated and substantially cylindrical shape with gas stream inlet 24, particulate outlet 26, gas stream outlet 28, interior wall 30, and exterior wall 32. Gas stream inlet 24 and particulate outlet 26 extend from separator 14*a* in the same direction and are substantially parallel to one another. The charged particulate gas stream enters separator 14*a* through gas stream inlet 24. After the particulates have been separated from the gas stream, the particulates are expelled from separator 14*a* through particulate outlet 26. Gas stream outlet 28 is substantially perpendicular to both gas stream inlet 24 and particulate outlet 26, with clean gas exiting from gas stream outlet 28 normal to the cross-section of separator 14*a*. Although FIGS. 2 and 3 show gas stream inlet 24 and particulate outlet 26 as slots that extend from separator 14*a* in the same direction and substantially parallel to one another, gas stream inlet 24 and particulate outlet 26 may be positioned in alternate geometric locations and configurations. For example, particulate outlet 26 may be a second chamber having any type of cross-section in fluid communication with separator 14*a*.

In one embodiment, gas stream inlet 24 and particulate outlet 26 are formed as narrow slots to distribute the gas stream lengthwise such that all of the particulates enter and exit separator 14*a* proximate interior wall 30. The locations of gas stream inlet 24 and particulate outlet 26 maintain a tangential gas flow with respect to interior wall 30 of separator 14*a*. By tangentially introducing the gas stream into separator 14*a*, a centrifugal force is created within separator 14*a*. The inertia of the particulates propels the heavier particulates toward interior wall 30 of separator 14*a* for at least a 180 degree revolution.

In one embodiment, interior wall 30 of separator 14*a* is coated with a non-conductive and/or low friction coating 34. Coating 34 serves to minimize or prevent particulate adhesion to interior wall 30 and prevents particulate discharge on interior wall 30. This reduces the likelihood of erosion or corrosion of separator 14*a* as well as the likelihood of sparking or arcing within separator 14*a*. Coating 34 can include, but is not limited to: glass, polymer, or other dielectric material.

The mechanical separation of the particulates from the gas stream through the centrifugal force is further enhanced by high voltage electrode 36. High voltage electrode 36 extends through separator 14*a* and establishes an electric potential relative to interior wall 30 of separator 14*a*, forming a positive electrostatic field within separator 14*a* to attract the negatively-charged particulates in the gas stream toward interior wall 30. The polarity of the potential applied to high voltage electrode 36 is the same as the charge imparted on the particulates. Thus, the electrostatic field repels the particulates from the core of separator 14*a* toward interior wall 30 of separator 14*a*.

As with high voltage electrode 20 in precharger 12 (shown in FIG. 1), high voltage electrode 36 can apply a pulsed voltage to the gas stream. This enables a higher average voltage to be applied in separator 14*a* without sparking. This in turn enables a higher inlet flow rate into each separator 14*a*, reducing the total footprint and cost of electrostatic particulate separation system 10 (shown in FIG. 1). Also similar to discharge electrode 20 of precharger 12, in one embodiment, a dielectric coating 38 is coated on high voltage electrode 36 of separator 14*a*. Coating 38 serves to tailor the corona around high voltage electrode 36 in the embodiment without a precharger and/or reduce the likelihood of sparking or arcing within separator 14*a*. Coating 38 can include, but is not limited to: glass, polymer, or dielectric material.

Although FIGS. 2 and 3 are discussed as including high voltage electrode 36 within separator 14*a*, separator 14*a* may optionally not include a high voltage electrode or an imposed separator electrostatic field. When separation system 10 includes precharger 12, the electric field created by the space charge created by the charged particulates may be sufficient to concentrate the particulates into the bleed stream leaving particulate outlet 26. This also applies when the particulate material entering separation system 10 is charged by a piece of equipment located upstream.

After the particulates are separated from the gas stream, the particulates are expelled from separator 14*a* through particulate outlet 26. In one embodiment, the bleed stream constitutes approximately 10% of the initial gas stream flow entering from gas stream inlet 24. The efficiency of separator 14*a* is determined in part by the ratio of the length of particulate-rich gas stream inlet 24 to the length of particulate outlet 26. Particulate outlet 26 typically extends the length of separator 14*a*. The length of particulate-rich gas stream inlet 24 is preferably between approximately 50% and approximately 80% the length of particulate outlet 26, although it can also extend the length of separator 14*a*. The length of particulate-rich gas stream inlet 24 is most preferably between approximately 60% and approximately 70% the length of particulate outlet 26.

Figure 4:
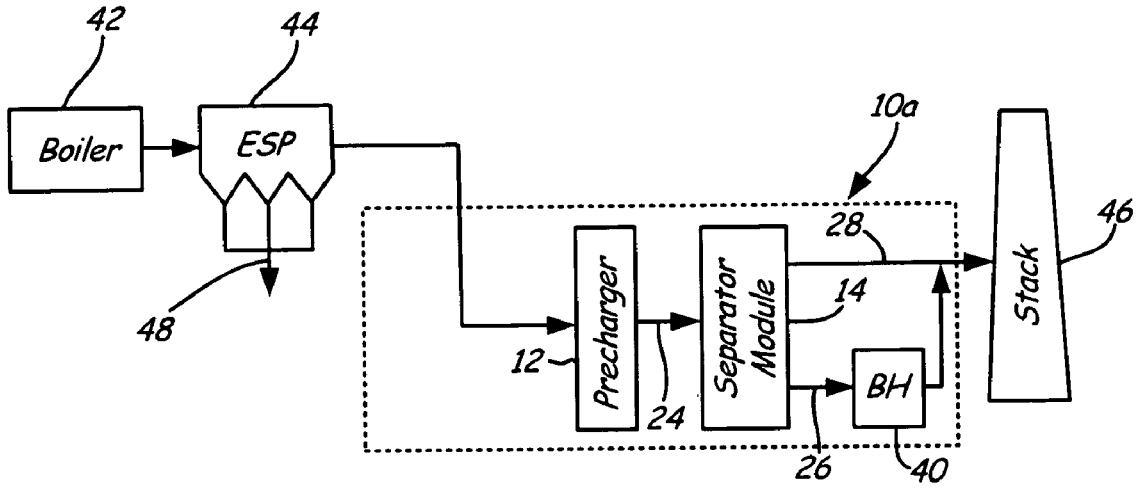
FIG. 4 is a block diagram of a first embodiment of the electrostatic particulate separation system.

FIG. 4 shows a block diagram of a first embodiment of electrostatic particulate separation system 10*a*. Separation system 10*a* generally includes precharger 12, separator module 14, and small baghouse (BH) 40. Boiler 42 and electrostatic precipitator (ESP) 44 are located upstream of separation system 10*a* and stack 46 is located downstream of separation system 10*a*. Boiler 42 generates steam to be used for a variety of purposes. For example, the steam can be sent through a steam turbine that drives a generator to create electricity. The steam can alternatively also be sent to a building or process to provide heat or steam. However, in the process of generating the steam, the boiler also creates an exhaust gas stream that contains particulates and other pollutants. ESP 44 is positioned downstream of boiler 42 to perform an initial collection of particulates in the gas stream before the gas stream enters separation system 10*a*. In this embodiment, ESP 44 also represents the existing particulate emissions control equipment of boiler 42. The collected particulates are expelled from electrostatic precipitator 44 through discharge line 48.

Precharger 12 and separator module 14 of separation system 10*a* are connected and function as discussed above. After the gas stream has passed through separator module 14, the gas stream from particulate outlet 26 is sent to small baghouse 40. Small baghouse 40 is connected downstream of separator module 14 and has the benefit of being simple to install in retrofit applications and therefore exerts minimal impact on existing plant infrastructure. Additionally, the use of small baghouse 40, as opposed to a conventionally sized baghouse, lowers the capital and operating cost of separation system 10*a*. After the gas stream has passed through separation system 10*a*, the clean gas stream exits separation system 10*a* through gas stream outlet 28 to stack 46 where it is joined by clean outflow from baghouse 40 and is vented into the atmosphere.

Figure 5:
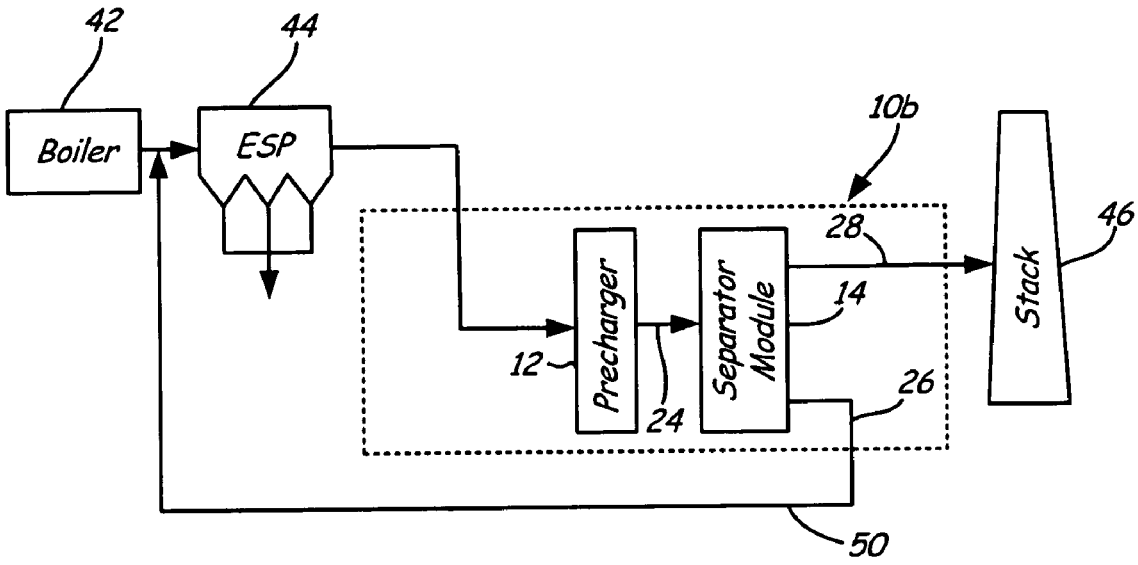
FIG. 5 is a block diagram of a second embodiment of the electrostatic particulate separation system.

FIG. 5 shows a block diagram of a second embodiment of electrostatic particulate separation system 10*b*. Separation system 10*b* generally includes precharger 12, separator module 14, and recycle line 50. Similar to separation system 10*a*, boiler 42 and electrostatic precipitator 44 are located upstream of separation system 10*a* and stack 46 is located downstream of separation system 10*b*. Precharger 12, separator module 14, boiler 42, electrostatic precipitator 44, and stack 46 operate as discussed above. Recycle line 50 feeds the particulates from the bleed stream leaving through particulate outlet 26 back into separation system 10*b* upstream of electrostatic precipitator 44, eliminating the need for a baghouse. In an alternative embodiment, recycle line 50 may optionally feed back into separation system 10*b* upstream of precharger 12. The particulates are thus collected and expelled in electrostatic precipitator 44 or precharger 12. By eliminating a baghouse from the system design, the capital and operating costs of separation system 10*b* is decreased.

Figure 6:
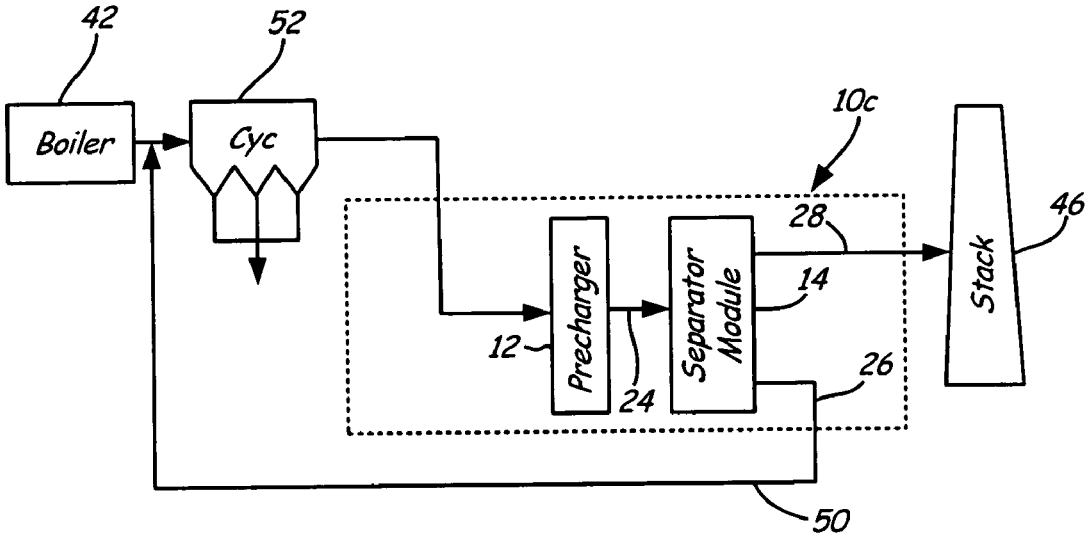
FIG. 6 is a block diagram of a third embodiment of the electrostatic particulate separation system.

FIG. 6 shows a block diagram of a third embodiment of electrostatic particulate separation system 10*c*. Separation system 10*c* generally includes precharger 12, separator module 14, and recycle line 50. Separation system 10*c* is identical to separation system 10*b*, except that cyclonic separator (Cyc) 52 is positioned between boiler 42 and separation system 10*c* in place of electrostatic precipitator 44. Recycle line 50 thus feeds the particulates from the bleed stream of separator module 14 back into separation system 10*c* upstream of cyclonic separator 52, eliminating the need for a baghouse. Cyclonic separator 52 functions similarly to electrostatic precipitator 44, performing an initial collection of particulates from the gas stream. In addition, similar to separation system 10*b*, recycle line 50 may optionally feed back into separation system 10*c* upstream of precharger 12. In an alternative embodiment, recycle line 50 may optionally be replaced with a small baghouse to collect the particulates from the bleed stream.

Figure 7:
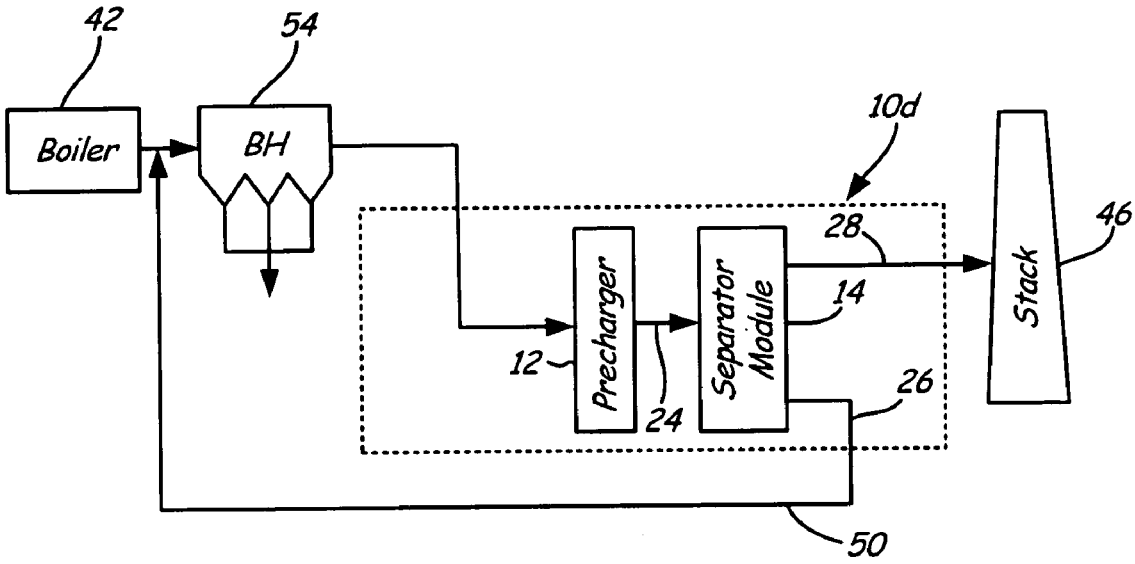
FIG. 7 is a block diagram of a fourth embodiment of the electrostatic particulate separation system.

FIG. 7 shows a block diagram of a fourth embodiment of electrostatic particulate separation system 10*d*. Separation system 10*d* generally includes precharger 12, separator module 14, and recycle line 50. Separation system 10*d* is identical to separation systems 10*b* and 10*c*, except that conventional baghouse 54 is positioned between boiler 42 and separation system 10*d* in place of electrostatic precipitator 44. Recycle line 50 thus feeds the particulates from the bleed stream exiting separator module 14 through particulate outlet 26 back into separation system 10*d* upstream of baghouse 54. Similar to separation system 10*b*, recycle line 50 may optionally feed back into separation system 10*b* upstream of precharger 12. Precharger 12 functions similarly to electrostatic precipitator 44 and cyclonic separator 52, performing an initial collection of particulates from the gas stream. In an alternative embodiment, recycle line 50 may optionally be replaced with a small baghouse to collect the particulates from the bleed stream.

Figure 8:
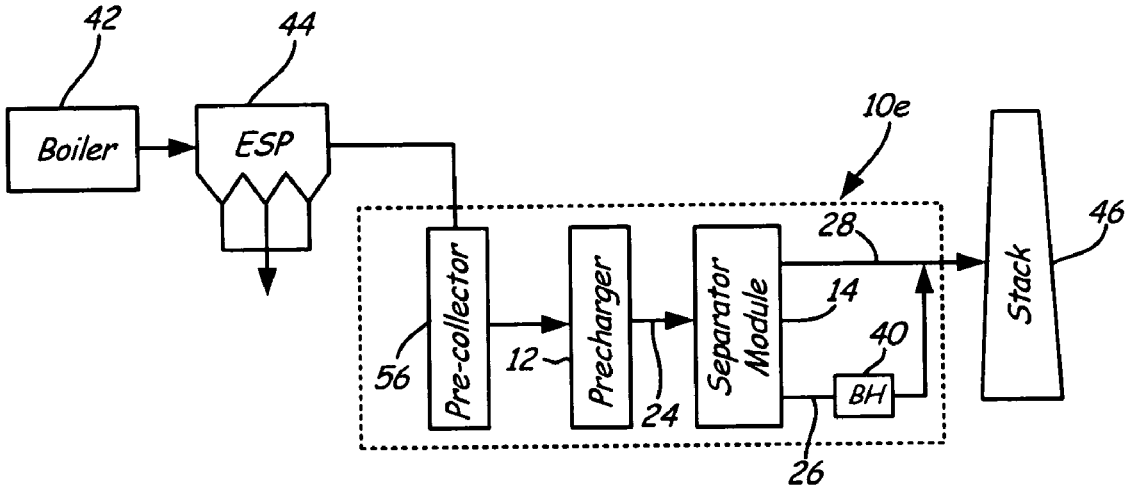
FIG. 8 is a block diagram of a fifth embodiment of the electrostatic particulate separation system.

FIG. 8 shows a block diagram of a fifth embodiment of electrostatic particulate separation system 10*e*. Separation system 10*e* generally includes precharger 12, separator module 14, small baghouse 40, and pre-collector 56. Separation system 10*e* is identical to separation system 10*a*, except that separation system 10*e* includes pre-collector 56 upstream of precharger 12. Pre-collector 56 performs an initial collection of particulates from the gas stream and can include any separation device, including separation devices having low separation efficiency. Separation system 10*e* is used in applications with highly rich gas stream inlet loadings. Optionally, a recycle line can replace small baghouse 40 and recycle the particulates from particulate outlet 26 of separator module 14 upstream of electrostatic precipitator 44 or upstream of pre-collector 56 for collection. A cyclonic separator may also optionally be used in place of electrostatic precipitator 44.

Figure 9:
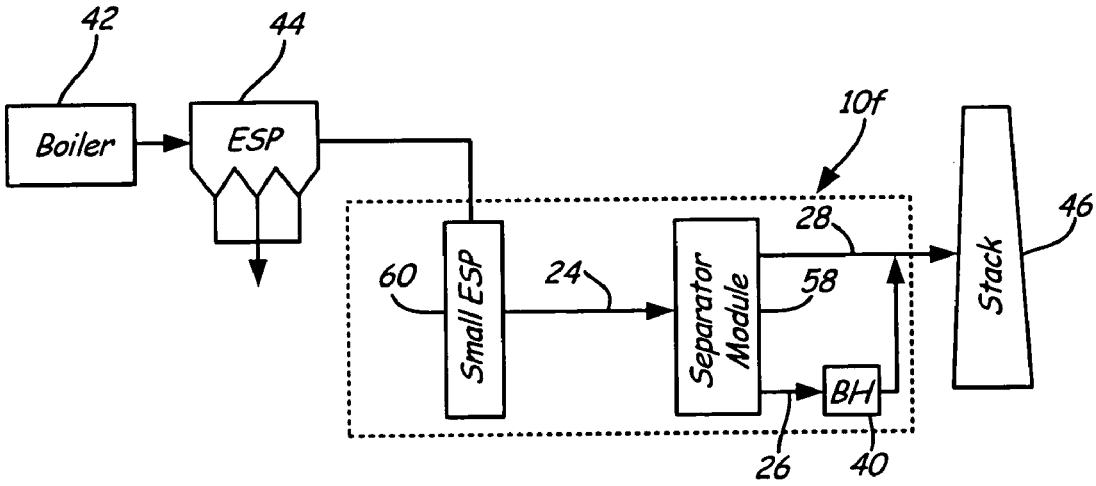
FIG. 9 is a block diagram of a sixth embodiment of the electrostatic particulate separation system.

FIG. 9 shows a block diagram of a sixth embodiment of electrostatic particulate separation system 10*f*. Separation system 10*f* generally includes separator module 58, small baghouse 40, and small electrostatic precipitator 60. Separation system 10*f* is identical to separation system 10*e*, except that separation system 10*f* includes small electrostatic precipitator 60 in place of pre-collector 56 and the need for a precharger is eliminated by generating the corona and charging the particulates in small ESP 60. Similar to separation system 10*e*, small baghouse 40 can be eliminated and a recycle line can optionally be used to recycle the particulates from separator module 14 to upstream of electrostatic precipitator 44 or small electrostatic precipitator 60 for collection.

Figure 10:
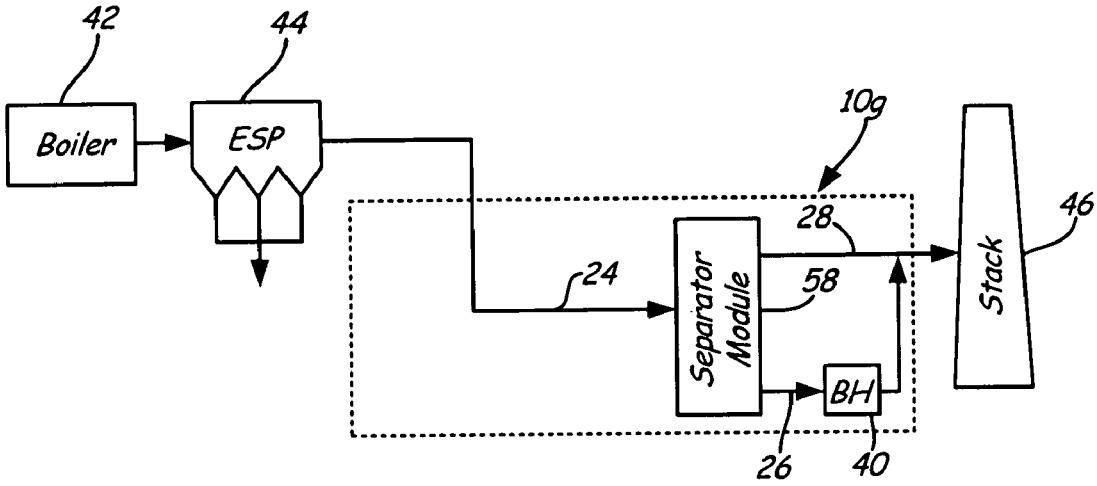
FIG. 10 is a block diagram of a seventh embodiment of the electrostatic particulate separation system.

FIG. 10 shows a block diagram of a seventh embodiment of electrostatic particulate separation system 10*g*. Separation system 10*g* generally includes separator module 14 and small baghouse 40. Separation system 10*g* is identical to separation 10*f* except that separation system 10*g* does not include a small electrostatic precipitator. Separation system 10*g* can be used in conjunction with either small baghouse 40 or with recycle line 50. This configuration may be used in a retrofit application to upgrade the performance of an underperforming ESP or in new installations to minimize the total cost of a combined electrostatic precipitator/separation system.

Although electrostatic particulate separation systems 10*a*-10*g* have been described as processing the exhaust gas stream of a boiler, electrostatic particulate separation systems 10*a*-

10*g* may be used in any application where it is desired to remove particulate material from a gas stream.

The electrostatic particulate separation system of the present invention, and the device which may be incorporated into such a system, efficiently concentrates and expels particulates from a gas stream through a particulate bleed stream. By pulsing the voltage applied to the gas stream and using various equipment, the size requirements and total system cost of the separation system are reduced while increasing effectiveness. Coating the separator module or discharge electrodes of the precharger and/or separator may minimize or prevent sparking and arcing in the precharger and separator module. The electrostatic particulate separation system has the advantages of simplicity and reliability while avoiding problems such as high pressure drops and high operating costs that are present in conventional particulate separation systems.

Although the present invention has been described with reference to preferred embodiments, workers skilled in the art will recognize that changes may be made in form and detail without departing from the spirit and scope of the invention.

The invention claimed is:

1. A device for separating particulates from a gas stream flowing through the device, the device comprising:

at least one high voltage electrode for applying a first voltage to the gas stream, wherein the at least one high voltage electrode is configured as a precharger;

at least one substantially cylindrical separator having an inlet for introducing the gas stream into the separator tangentially to an interior wall of the separator, a particulate outlet for expelling the particulates from the separator, and a gas stream outlet, wherein the particulate outlet is circumferentially spaced from the inlet by at least about 180° along the interior wall; and a second high voltage electrode positioned within the separator for applying a second voltage to the gas stream.

2. The device of claim 1, wherein the first applied voltage is pulsed.

3. The device of claim 1, wherein at least one of the first applied voltage and the second applied voltage is pulsed.

4. The device of claim 1, wherein at least one of the first high voltage electrode, the second high voltage electrode, and the interior wall of the separator is coated with a dielectric material.

5. The device of claim 1, wherein the inlet introduces the gas stream into the separator at a velocity of between about 5 feet per second and about 35 feet per second.

6. The device of claim 5, wherein the inlet introduces the gas stream into the separator at a velocity of between about 10 feet per second and about 30 feet per second.

7. The device of claim 6, wherein the inlet introduces the gas stream into the separator at a velocity of between about 12 feet per second and about 22 feet per second.

8. The device of claim 1, wherein the inlet has a first length and the particulate outlet has a second length, and wherein the first length is between about 50% and about 80% of the second length.

9. The device of claim 8, wherein the inlet has a first length and the particulate outlet has a second length, and wherein the first length is between about 60% and about 70% of the second length.

10. The device of claim 1, wherein the inlet and the particulate outlet are both configured as slots arranged substantially parallel to a center axis of the substantially cylindrical separator.

11. A system for separating particulates from a gas stream flowing through the system, the system comprising:

a high voltage electrode for applying a voltage to the gas stream; and a plurality of separators, each of the separators having an inlet for introducing the gas stream into the separator tangentially to an interior wall of the separator, a first outlet for expelling the particulates from the separator, and a second outlet for expelling the gas stream from the separator, wherein the first outlet is circumferentially spaced from the inlet by at least about 180° along the interior wall, and wherein the plurality of separators are positioned parallel to each other in a chevron pattern.

12. The system of claim 11, and further comprising an electrostatic preciptator positioned upstream of the separator.

13. The system of claim 12, wherein the inlet introduces the gas stream into the separator at a velocity of between about 5 feet per second and about 35 feet per second.

14. The system of claim 13, wherein the inlet introduces the gas stream into the separator at a velocity of between about 10 feet per second and about 30 feet per second.

15. The system of claim 14, wherein the inlet introduces the gas stream into the separator at a velocity of between about 12 feet per second and about 22 feet per second.

16. The system of claim 12, wherein the inlet has a first length and the first outlet has a second length, and wherein the first length is between about 50% and about 80% of the second length.

17. The system of claim 16, wherein the inlet has a first length and the first outlet has a second length, and wherein the first length is between about 60% and about 70% of the second length.

18. The system of claim 12, and further comprising at least one of a baghouse, a cyclonic separator, and an electrostatic precipitator.

19. The system of claim 18, and further comprising a precharger upstream of the separator.

20. The system of claim 18, and further comprising a recycle line, wherein the recycle line transports the particulates from the separator to upstream of the separator.

21. The system of claim 18, and further comprising a baghouse positioned downstream of the separator for collecting the particulates from the separator.

22. The system of claim 18, and further comprising a pre-collector positioned upstream of the separator.

23. An electrostatic particulate separation system for separating particulates from a particulate-rich gas stream, the system comprising:

a high voltage electrode for applying a voltage to the particulate-rich gas stream;

a separator having an inlet for introducing the particulate-rich gas stream into the separator tangentially to an interior wall of the separator and an outlet for expelling the particulates from the separator, wherein the interior wall of the separator is coated with a non-conductive coating, and wherein the high voltage electrode is positioned within the separator; and a precharger located upstream of the separator.

24. The system of claim 23, wherein the high voltage electrode applies a pulsed voltage to the gas stream.

25. The system of claim 23, wherein the high voltage electrode is coated with a non-conductive coating.

26. The system of claim 23, wherein the inlet has a first length and the outlet has a second length, and wherein the first length is between about 50% and about 80% of the second length.

27. The system of claim 26, wherein the inlet has a first length and the outlet has a second length, and wherein the first length is between about 60% and about 70% of the second length.

28. The system of claim 23, wherein the inlet introduces the particulate-rich gas stream into the separator at a velocity of between about 5 feet per second and about 35 feet per second.

29. The system of claim 28, wherein the inlet introduces the particulate-rich gas stream into the separator at a velocity of between about 10 feet per second and about 30 feet per second.

30. The system of claim 29, wherein the inlet introduces the particulate-rich gas stream into the separator at a velocity of between about 12 feet per second and about 22 feet per second.

31. The system of claim 23, and further comprising at least one of a baghouse, a cyclonic separator, and an electrostatic precipitator located upstream of the separator.

32. The system of claim 31, and further comprising a recycle line, wherein the recycle line transports the particulates from the separator to upstream of the separator.

33. The system of claim 31, and further comprising a baghouse positioned downstream of the separator for collecting the particulates from the separator.

34. The system of claim 31, and further comprising a pre-collector positioned upstream of the separator.

35. The system of claim 23, and further comprising an electrostatic precipitator positioned upstream of the separator.

36. The system of claim 23, wherein the outlet is circumferentially spaced from the inlet by at least about 180° along the interior wall.

37. The system of claim 23 and further comprising:

at least one additional separator having an inlet for introducing the particulate-rich gas stream into the separator tangentially to an interior wall of the separator and an outlet for expelling the particulates from the separator, wherein the separators are arranged in a chevron pattern to operate in parallel.

* * * * *

UNITED STATES PATENT AND TRADEMARK OFFICE

CERTIFICATE OF CORRECTION

PATENT NO. : 7,527,675 B2
APPLICATION NO. : 11/520261
DATED : May 5, 2009
INVENTOR(S) : Luca Bertuccioli et al.

It is certified that error appears in the above-identified patent and that said Letters Patent is hereby corrected as shown below:

Col. 8, claim 13, line 1, delete "claim 12", insert --claim 11--

Col. 8, claim 16, line 1, delete "claim 12", insert --claim 11--

Col. 8, claim 18, line 1, delete "claim 12", insert --claim 11--

Signed and Sealed this

Twenty-ninth Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,527,675 B2
APPLICATION NO. : 11/520261
DATED : May 5, 2009
INVENTOR(S) : Luca Bertuccioli et al.

It is certified that error appears in the above-identified patent and that said Letters Patent is hereby corrected as shown below:

Column 8, line 15 (claim 13, line 1) delete "claim 12", insert --claim 11--

Column 8, line 24 (claim 16, line 1) delete "claim 12", insert --claim 11--

Column 8, line 32 (claim 18, line 1) delete "claim 12", insert --claim 11--

This certificate supersedes the Certificate of Correction issued June 29, 2010.

Signed and Sealed this

Twentieth Day of July, 2010

David J. Kappos

David J. Kappos
*Director of the United States Patent and Trademark Office*